United States Patent [19]

Martin

[11] Patent Number: 4,719,900

[45] Date of Patent: Jan. 19, 1988

[54] GRATE FOR USE IN INDUSTRIAL FURNACES

[76] Inventor: Walter J. Martin, Leopoldstrasse 248, D-8000 München 40, Fed. Rep. of Germany

[21] Appl. No.: 873,011

[22] Filed: Jun. 11, 1986

[30] Foreign Application Priority Data

Jun. 13, 1985 [DE] Fed. Rep. of Germany ..... 3521266

[51] Int. Cl.[4] ..... F23H 11/00

[52] U.S. Cl. ..... 126/163 R; 126/167; 110/281; 110/298; 432/239

[58] Field of Search ..... 432/77, 83, 239, 173, 432/328; 34/164; 126/163 R, 152 R, 167, 174, 175; 110/281–288, 278, 271, 291, 327, 328, 298–300

[56] References Cited

U.S. PATENT DOCUMENTS

| | | | |
|---|---|---|---|
| 966,233 | 8/1910 | Nordell | 110/299 |
| 1,481,366 | 1/1924 | Herkenrath | 126/163 R |
| 1,542,910 | 6/1925 | Reid | 126/163 R |
| 2,745,364 | 5/1956 | Martin | 110/298 |
| 3,508,535 | 4/1970 | Martin et al. | 126/163 R |
| 4,240,402 | 12/1980 | Martin et al. | 126/167 |
| 4,463,688 | 8/1984 | Andreoli | 110/281 |
| 4,671,190 | 6/1987 | Moreau | 110/281 |
| 4,672,947 | 6/1987 | Martin | 126/167 |

FOREIGN PATENT DOCUMENTS

| | | | |
|---|---|---|---|
| 970380 | 8/1958 | Fed. Rep. of Germany | 34/164 |
| 1076466 | 9/1954 | France | 126/163 |
| 24720 | 2/1983 | Japan | 126/163 R |

*Primary Examiner*—James C. Yeung
*Attorney, Agent, or Firm*—Darby & Darby

[57] ABSTRACT

The grate of an industrial furnace is assembled of elongated grate bars which form rows of neighboring grate bars and the grate bars of neighboring rows partially overlap each other. Each grate bar has a top wall, a front end wall and two sidewalls, and such walls define an air-admitting passage having a portion in one or more hollow upward extensions of the top wall close to the front end wall. The extensions have transverse openings which discharge air from the respective portions of the passages into the surrounding atmosphere, namely into fuel which is deposited on the grate. The openings of each extension are located in planes which are inclined to the longitudinal direction of the corresponding top walls through angles of 80–90 degrees, and such openings can be inclined forwardly, rearwardly, downwardly or upwardly. If the grate bars have top walls with several extensions, the openings in the extensions of each grate bar can be staggered relative to each other. This also applies for the openings in the extension of neighboring grate bars. The neighboring grate bars are coupled to each other against sliding movement relative to one another.

19 Claims, 6 Drawing Figures

GRATE FOR USE IN INDUSTRIAL FURNACES

CROSS-REFERENCE TO RELATED CASE

The grate of the present invention constitutes an improvement over grates utilizing grate bars of the type disclosed in the copending patent application Ser. No. 763,880 of Johannes Josef Edmund Martin filed Aug. 8, 1985 for "Grate bar for use in industrial furnaces", U.S. Pat. No. 4,672,947.

BACKGROUND OF THE INVENTION

The invention relates to grates in general, particularly to improvements in grates for industrial furnaces. The invention also relates to improvements in grate bars which can be used in such grates to support and to admit oxygen into a layer of coal or other solid fuel.

It is known to provide a grate bar with a passage which admits atmospheric air into the fuel layer on the grate bar. It is also known to provide the grate bar with an upward extension having an opening for admission of air into the fuel layer. Rows of such grate bars are assembled into a grate which must prevent particles of fuel and/or combustion products from descending into the space below the grate because this could entail rapid contamination of the furnace by fuel, ashes, cinder and like substances and would interfere with movements of grate bars relative to each other. On the other hand, the grate should ensure a substantially uniform distribution of oxygen in the fuel layer on the top walls of the grate bars. Heretofore known grates and grate bars cannot fully satisfy the above seemingly conflicting requirements, i.e., they either favor uniform distribution of oxygen while permitting a relatively large quantity of fuel and/or combustion products to descend through the grate or vice versa.

Attempts to overcome the aforediscussed drawbacks of conventional grates include such orientation of openings in the extensions of the top walls of the grate bars that the streams of oxygen flow rearwardly in the longitudinal direction of the grate bars. This creates problems in connection with certain types of fuel, e.g., when the fuel contains paper, plastics and like relatively lightweight constituents which are blown into the rear portion of the furnace and cannot be fully combusted on the grate. Another drawback of such proposal is that the particles of fuel and/or combustion products are likely to clog the openings in response to forward and rearward movements of the grate bars in a manner which is customary in many types of grates for use in industrial furnaces. This will be readily appreciated because the open end of each opening advances directly into the adjacent mass of fuel and/or combustion products during rearward movement of the respective grate bar and/or during forward movement of the immediately following grate bar. The mechanism which reciprocates the grate bars will cause particles of fuel and/or combustion products to penetrate into and to jam in the openings so that the rate of oxygen flow into the fuel layer is unduly affected with attendant reduction of the percentage of fully combusted fuel.

OBJECTS AND SUMMARY OF THE INVENTION

An object of the invention is to provide a novel and improved grate wherein the distribution of oxygen which is caused to flow into the fuel layer on the grate is more uniform than in heretofore known grates, even after extended periods of use.

Another object of the invention is to provide novel and improved grate bars for use in the above outlined grate.

A further object of the invention is to provide a grate whose bars are less likely to be clogged with particles of fuel and/or combustion products than the bars of conventional grates.

An additional object of the invention is to provide a furnace which embodies the above outlined grate.

Still another object of the invention is to provide a novel and improved method of admitting streams of oxygen into a layer of fuel on a composite grate which is assembled from rows of relatively movable grate bars.

A further object of the invention is to provide a grate bar which can be used in existing grates as a superior substitute for conventional grate bars.

Another object of the invention is to provide a novel and improved grate which can be used in existing furnaces as a superior substitute for conventional grates.

The invention is embodied in a grate, particularly for use in industrial furnaces, which comprises a grate bar including a top wall with a front end and a rear end, a front wall which extends substantially transversely of the front end of and downwardly from the top wall, and a pair of sidewalls which flank the top wall and extend downwardly from its marginal portions. The sidewalls, the top wall and the front wall together define at least one air admitting passage, and the top wall has at least one hollow upward extension which is adjacent the front end of the top wall and defines a portion of the passage. The extension has at least two lateral openings which constitute outlets connecting the aforementioned portion of the passage with the surrounding atmosphere.

The extension can taper upwardly and/or its width can be less than the distance between the sidewalls of the grate bar.

The openings can be disposed in planes which make with the longitudinal direction of the top wall an angle of between approximately 80 and 90 degrees. The openings can be inclined to the horizontal, either upwardly or downwardly.

The extension can be provided with nozzles having orifices which constitute the outlet openings. Such orifices can be bounded by relatively smooth surfaces of the nozzles or by surfaces which are designed to swirl the streams of air flowing from the passage or passages into the surrounding atmosphere. The dimensions of the openings transversely of the top wall can exceed the dimensions of the openings in the longitudinal direction of the top wall.

The top wall can be provided with two or more hollow extensions, and the openings in one of the extensions can be offset relative to the openings in another extension. Furthermore, the openings of each extension can be offset relative to each other.

Each extension can be provided with three or more openings, e.g., with two or more openings in each of its lateral portions. If the grate bar has several extensions, such extensions can be staggered relative to each other in the longitudinal direction of the top wall of the grate bar. The cross-sectional area of at least one opening can decrease in a direction from the passage portion in the extension toward the surrounding atmosphere.

Neighboring grate bars of a row of grate bars can be separably coupled to each other. Thus, one sidewall of one grate bar can be placed next to one sidewall of the neighboring grate bar and such grate bars can be coupled to each other against movement of the abutting or neighboring sidewalls along each other. This can be achieved by providing one or more recesses in one of the two neighboring sidewalls and by providing the other sidewall of the two neighboring sidewalls with a projection which extends into the recess.

The novel features which are considered as characteristic of the invention are set forth in particular in the appended claims. The improved grate itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
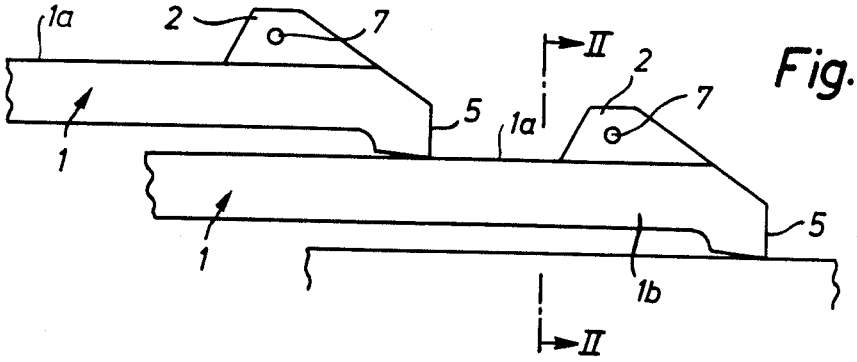
FIG. 1 is a fragmentary elevational view of a grate with two partially overlapping grate bars which are constructed in accordance with one embodiment of the invention.

FIG. 1 shows a portion of a grate which can be used in an industrial furnace and comprises several rows of partially overlapping grate bars 1. The front end wall 5 of the right-hand grate bar 1 rests on a frame member of the furnace, and the front end wall 5 of the left-hand grate bar 1 rests on the median portion of the top wall 1*a* of the right-hand grate bar. Each grate bar 1 further comprises two sidewalls or lateral walls 1*b*, 1*c* (see FIG. 2) which extend downwardly from the longitudinally extending marginal portions of the respective top wall 1*a*. Furthermore, each top wall 1*a* has a hollow upward extension 2 which is adjacent its front end, i.e., at least reasonably close to the front wall 5. The walls 1*a*, 1*b*, 1*c*, 5 together define an air admitting passage 3 which is open at its underside and/or at its rear end (as fully disclosed in the aforementioned copending patent application Ser. No. 763,880 whose disclosure is incorporated herein by reference), and a portion 4 of the passage 3 (see FIG. 3) is defined by the hollow extension 2. In accordance with a feature of the invention, the lateral portions 2*a* of the extension 2 are provided with outlets in the form of substantially or nearly horizontal openings 7 extending substantially transversely of the longitudinal direction of the top wall 1*a*. Air which enters the passage 3 from below or from the rear end of the respective grate bar 1 cools the grate bar and is thereupon admitted, via openings 7, into the mass of fuel resting on the grate.

Figure 2:
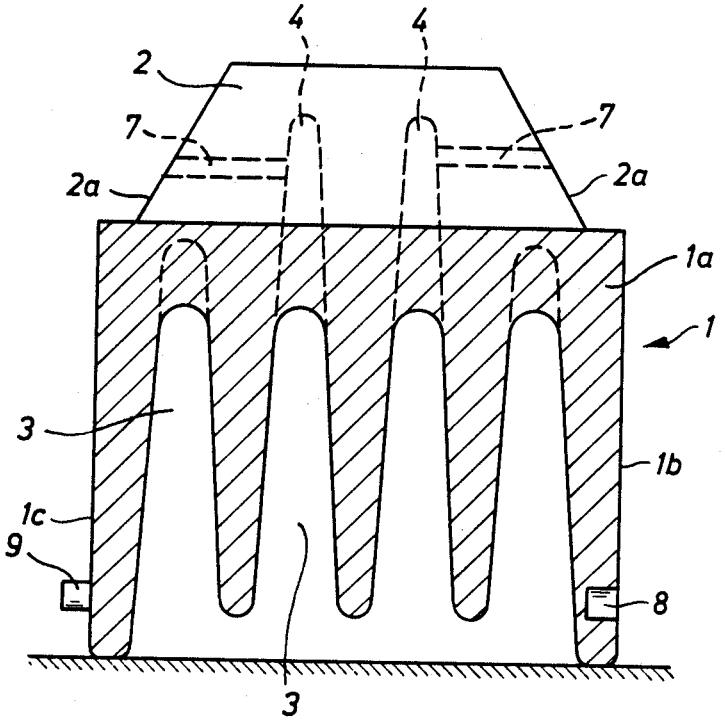
FIG. 2 is an enlarged transverse vertical sectional view of one of the grate bars as seen in the direction of arrows from the line II—II of FIG. 1.
Figure 3:
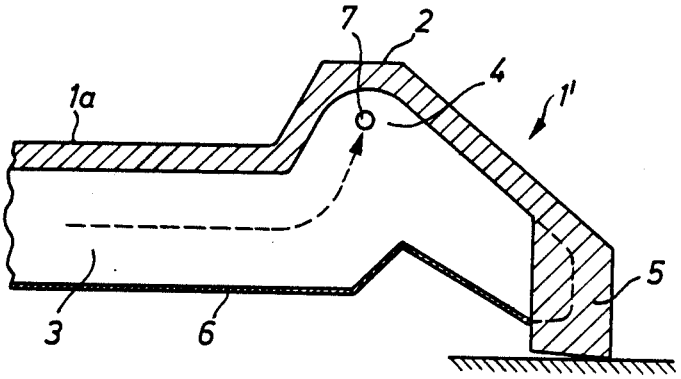
FIG. 3 is a fragmentary longitudinal vertical sectional view of a modified grate bar.

FIG. 2 shows that the underside of the grate bar 1 is open to allow for practically unimpeded entry of cool air from below the grate. FIG. 3 shows a modified grate bar 1′ which comprises a relatively thin bottom wall 6 below the passage 3. The inlet for admission of air into the passage 3 of FIG. 3 is disposed at the (non-illustrated) left-hand end of the grate bar 1′.

The purpose of the extensions 2 is to cooperate with the front end walls 5 of the grate bars 1 in the next following row of grate bars so as to squash accumulations of slag, cinder, fuel or other solid material in response to longitudinal movement of grate bars in one of two neighboring rows relative to the grate bars in the other row. Thus, a piece of cinder between the right-hand extension 2 of FIG. 1 and the front end wall 5 to the left of such extension will be comminuted in response to leftward movement of the right-hand grate bar 1 and/or in response to rightward movement of the left-hand grate bar 1. Means for moving rows of grate bars relative to each other (either by moving the grate bars of one row, by moving the grate bars of the other row, or by moving the grate bars of both rows) are well known in the art and form no part of the present invention. Reference may be had, for example, to U.S. Pat. Nos. 4,239,029, 4,520,792, 4,348,139 and 4,394,118.

Figure 4:
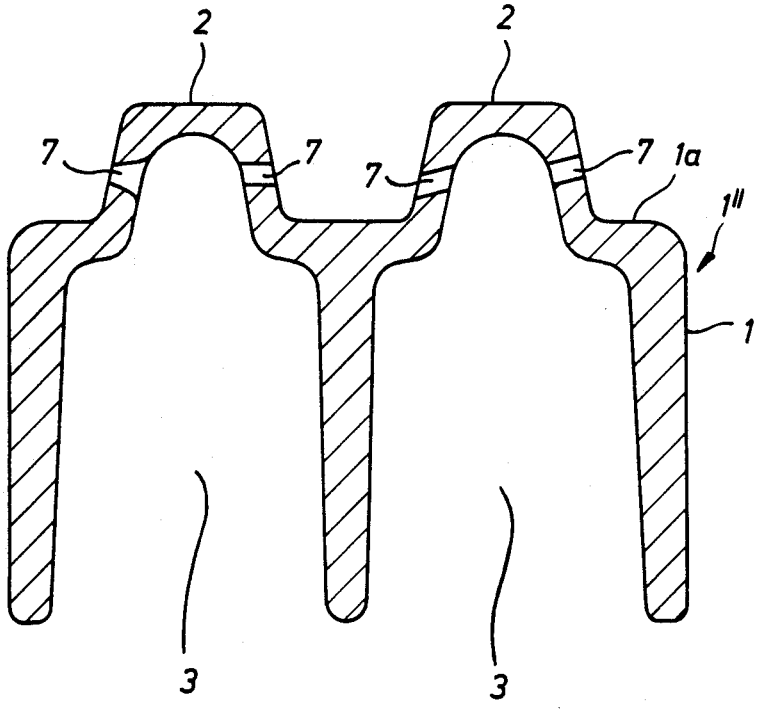
FIG. 4 is a transverse vertical sectional view of a third grate bar wherein the top wall has two extensions.

The openings 7 discharge streams of air substantially transversely of the longitudinal direction of the respective top walls 1*a*. The arrangement is preferably such that the openings 7 are disposed in planes which extend at right angles to the longitudinal direction of the respective top wall 1*a*, and the dimensions of each opening 7 are smaller in the longitudinal direction than in the transverse direction of the respective grate bar. As shown in FIG. 4 the openings 7 can discharge streams of air in directions which are inclined to the horizontal, and the inclination can be in the upward or in the downward direction. The inclination of the aforementioned planes to the longitudinal direction of the grate bars can be in the range of approximately 80–90 degrees. Thus, the openings 7 can discharge streams of air forwardly, rearwardly, upwardly or downwardly but generally in a direction transversely of the respective grate bars. Deviations in the range of up to and even in excess of 10 degrees (forwardly, rearwardly, upwardly or downwardly) from an optimum or standard direction (in a horizontal plane and exactly at 90 degrees to the longitudinal direction of the respective grate bar) are acceptable.

Each opening 7 can constitute a simple bore or hole having a constant diameter and bounded by a smooth surface of the respective extension 2. Alternatively, one or more openings 7 can constitute the orifices of nozzles and the cross-sectional areas of such orifices can decrease in the direction of flow of air from the respective extensions 2 (this can be seen in the left-hand portion of FIG. 4 which shows a modified grate bar 1″ with two extensions 2 disposed side by side). An advantage of openings whose diameters increase in a direction toward the interior of the respective extension is that any solid particulate material which happens to penetrate in the openings is much more likely to descend into the major portion of the respective passage not later than in response to an interruption of the flow of air from the passage 3, into the passage portion 4 within the respective extension 2, through the opening 7 and into the layer of fuel on the grate.

Figure 5:
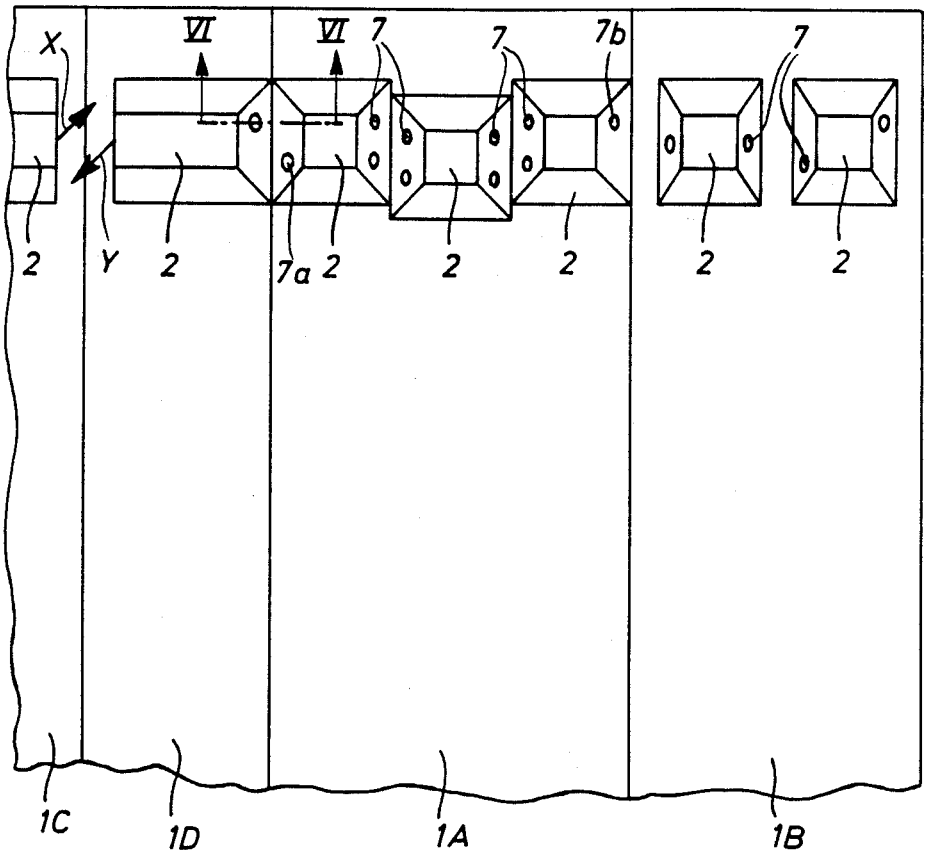
FIG. 5 is a fragmentary plan view of a row of grate bars which are constructed in accordance with additional embodiments of the invention.

FIG. 5 shows a centrally located grate bar 1A with three extensions 2 each of which has more than two transversely extending openings 7. The centrally located extension 2 is staggered with reference to the two outer extensions in the longitudinal direction of the top wall of the grate bar 1A. The centrally located extension 2 has two pairs of openings 7, the right-hand extension 2 has a pair of openings 7 in its left-hand lateral portion and a single opening 7 in its right-hand lateral portion, and the left-hand extension 2 has two openings 7 in its right-hand lateral portion but a single opening 7 in its left-hand lateral portion. The openings 7 in any given extension 2, as well as the openings in the neighboring extensions of any given grate bar and/or the openings in the extensions of two neighboring grate bars are or can be distributed and oriented in such a way that streams of air issuing from one of the extensions 2 cannot interfere with streams of air which issue from the adjacent extension or extensions. All this can be seen in FIG. 5. Thus, the right-hand opening 7 in the right-hand extension 2 of the rightmost grate bar 1B is staggered with reference to the left-hand opening 7 in the longitudinal direction of the top wall of such grate bar. The right-hand opening 7 of the left-hand extension 2 in the rightmost grate bar 1B is staggered with reference to the left-hand opening 7 of the right-hand extension 2, and the left-hand opening 7 of the left-hand extension 2 of the rightmost grate bar 1B is staggered or offset with reference to the single opening 7 in the right-hand portion of the rightmost extension 2 of the centrally located grate bar 1A. The same preferably applies for the openings 7 all other extensions 2. The left-hand portion of FIG. 5 shows two grate bars 1C and 1D with forwardly and rearwardly inclined openings for streams of air (indicated by arrows X and Y) which do not clash but bypass each other so as to ensure predictable admission of oxygen into the layer of fuel on the grate utilizing the bars of FIG. 5. FIG. 5 further shows that the width of individual extensions 2 on a grate bar or the combined width of all extensions on a grate bar can be less than the distance between the sidewalls of the respective grate bar. Thus, the combined width of the extensions 2 on the rightmost grate bar 1*b* of FIG. 5 is less than the width of the top wall of such grate bar. The width of the next-to-the-leftmost extension 2 (on the grate bar 1D) is also less than the width of the respective grate bar but the combined width of the three extensions 2 on the median grate bar 1A of FIG. 5 equals the distance between the outer sides of the corresponding sidewalls.

FIG. 5 also shows that the lateral surfaces of extensions can have different slopes. One lateral surface can extend at right angles to the exposed upper side of the respective top wall whereas the other lateral surface slopes laterally toward the respective sidewall. This is shown in the left-hand portion of FIG. 5 (note the grate bar 1D).

The distribution and orientation of openings 7 in all or some of the extensions 2 is or can be the same if the extensions are staggered in the longitudinal direction of the respective top wall as shown in the middle of FIG. 5 because this also ensures that the streams of air issuing from the openings 7 do not interfere with each other. The distribution of openings 7 in the two outer extensions 2 of the grate bar 1A of FIG. 5 is such that air streams issuing from the openings of neighboring grate bars which are identical with the grate bar 1A will not interfere with the streams issuing from the openings marked 7*a* and 7*b*.

The openings 7 can be bounded by surfaces having a circular, oval, polygonal or other cross-sectional outline. It is further possible to provide the extensions 2 with surfaces which cause the streams of air flowing through their openings to swirl in order to ensure more satisfactory distribution of oxygen in the layer of fuel and/or deeper penetration of oxygen into fuel. It is presently preferred to configurate the surfaces around the openings 7 in such a way that the openings are not long (as considered in the longitudinal direction of the respective grate bar).

The configuration of extensions 2 can depart from those which are shown in the drawing without departing from the spirit of the invention. It is important to ensure that the grate bars be provided with a sufficient number of properly dimensioned and oriented openings 7 so as to guarantee a predictable and satisfactory admission of oxygen into the layer of fuel on the grate.

FIG. 2 shows that the right-hand sidewall 1*b* of the grate bar 1 has a recess 8 and that the left-hand sidewall 1*c* has a pin- or stud-shaped projection 9 which is receivable in the recess of the adjacent sidewall. This simple coupling renders it possible to lock the neighboring grate bars against movement of their abutting sidewalls along each other. Thus, the abutting sidewalls can be readily separated by moving them sideways and away from each other but they cannot slide along each other as long as the projection 9 in one of the neighboring sidewalls extends into the recess 8 of the other sidewall. The coupling including the projection 9 and the recess 8 prevents a lifting of grate bars in an assembled grate but allows for accurate and predictable assembly of several grate bars into a row of abutting grate bars which are disposed side by side.

Figure 6:
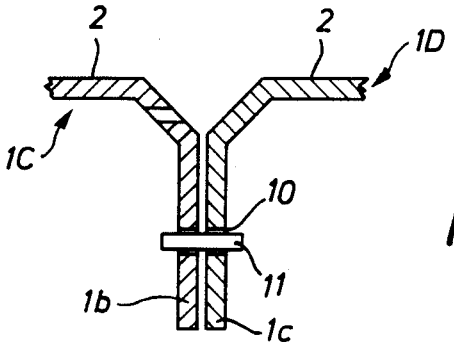
FIG. 6 is a fragmentary transverse sectional view of two neighboring grate bars whose sidewalls are separably coupled to each other, the section being taken in the direction of arrows from the line VI—VI in FIG. 5.

FIG. 6 shows a modified coupling which is used between the two leftmost grate bars 1C and 1D of FIG. 5. This coupling comprises a discrete pin-shaped projection 11 which is received in registering recesses or apertures 10 of the neighboring sidewalls 1*b*, 1*c* of the corresponding grate bars. The pin-shaped projection 11 of FIG. 6 also prevents a lifting of the left-hand or of the right-hand grate bar in a row of such grate bars.

An important advantage of the improved grate bars and of the grate which utilizes such grate bars is that the grate can admit into the fuel layer a large number of properly distributed streams of oxygen in directions such that the openings 7 which discharge oxygen are much less likely to be clogged by particles of fuel and/or by particles of combustion products than in heretofore known grates. The number of openings 7 is large because each extension 2 has at least two openings and because the top wall of each grate bar can be provided with one, two or more extensions.

Another important advantage of the improved grate bars and of the grate which embodies such grate bars is that the cross-sectional area of each opening 7 can be reduced to a small fraction of the cross-sectional areas of openings in conventional grate bars. This is due to the fact that each extension 2 has several openings 7 so that the quantity of oxygen which must be discharged through a single opening in a conventional grate bar can be discharged through two, three or more openings 7 in the grate bars of the present invention. It is not necessary to reduce the quantity of oxygen which is admitted into the layer of fuel on the grate; all that happens is that an optimum quantity of oxygen is admitted into the fuel layer through a large number of relatively small openings which are oriented and distributed in such a way that they are unlikely to be clogged and that streams of oxygen issuing from any selected opening do not interfere with the stream or streams which issue from the adjacent opening or openings. The provision of relatively small openings is desirable and advantageous on the additional ground that these openings offer a greater resistance to the flow of oxygen therethrough so that the distribution of oxygen in the fuel layer is more satisfactory. Furthermore, the direction of flow of oxygen into the fuel layer can be regulated with a higher degree of accuracy.

Still further, relatively small openings are less likely to be clogged by solid particles, especially by relatively large solid particles which cannot be readily expelled from the grate bars.

The feature that the openings 7 discharge streams of oxygen substantially transversely of the respective grate bars ensures that the furnace is less likely to incompletely combust certain types of fuel, for example, paper, lightweight plastic materials and the like. The reason is that the streams of gaseous fluid issuing from the openings 7 flow sideways and cannot propel lightweight particles into the rear end of the furnace where the combustion of accumulated lightweight fuel is much less likely to be satisfactory than at the center of the furnace.

The lateral portions 2*a* of the extensions 2 (namely the portions which are provided with the openings 7) do not travel directly against the adjacent masses of fuel and/or combustion products when the grate bars are in motion. Instead, the lateral portions 2*a* of the extensions 2 slide along the adjacent solid particulate material so that the solid particulate material is much less likely to penetrate into the openings 7 than in conventional grate bars wherein the outer ends of the openings are caused to move head on against the adjacent accumulations of solid particulate material and/or vice versa.

The aforediscussed configuration and orientation of openings 7 (so that the dimensions of the openings in the longitudinal direction of the grate bars are smaller than in the transverse direction of the grate bars) also contributes to a reduction of the likelihood of clogging of the openings with solid particulate material.

The provision of two or more extensions 2 on some or all of the grate bars entails a further increase in the number of openings 7 per grate bar so that the cross-sectional area of each opening can be reduced still further without reducing the quantity of admitted oxygen even though the uniformity of distribution of oxygen in the fuel layer is increased proportionally with an increase in the total number of openings. Uniform distribution of oxygen in a fuel layer resting on the just described grate bars with plural extensions is attributable to the increased number of openings as well as to a reduction of the cross-sectional area of each opening in comparison with the openings of grate bars each of which has a single opening.

The number of openings 7 can be doubled by providing each grate bar with two extensions 2 and by providing each extension with two pairs of transversely extending openings. The openings of such grate bars are even less likely to be clogged while ensuring a highly satisfactory distribution of oxygen in the fuel layer.

As mentioned above, the distribution of openings in individual extensions, in two or more extensions of a given grate bar and/or in the extensions of neighboring grate bars can be selected practically at will as long as the stream issuing from any given opening does not interfere with streams which issue from the adjacent opening or openings. The openings in neighboring grate bars of a row of grate bars can be staggered relative to each other in the longitudinal direction of the respective grate bars and/or otherwise (by being inclined downwardly, upwardly, forwardly and/or rearwardly) for the purpose of preventing interference between streams of oxygen and of ensuring predictable distribution of oxygen in the fuel layer or layers.

Coupling of neighboring grate bars in a row of grate bars is desirable and advantageous because this prevents accidental lifting of a grate bar and the resulting deviation of distribution of oxygen in the fuel from an optimum or preselected distribution. Thus, a slightly or a fully lifted grate bar would permit large quantities of oxygen to enter the adjacent portion of a fuel layer while the neighboring portions of the fuel layer would receive a reduced quantity of oxygen or no oxygen at all. The provision of coupling means between the neighboring sidewalls of grate bars in a row of grate bars is optional but is desirable and advantageous, especially in connection with the combustion of certain types of fuel.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a grate, particularly for use in industrial furnaces, a grate bar comprising a top wall having a front end and a rear end; a front wall extending substantially transversely of and downwardly from the front end of said top wall; and a pair of sidewalls flanking said top wall and extending downwardly therefrom, said walls defining at least one air admitting passage and said top wall having at least one hollow upward extension adjacent said front end and defining a portion of said passage, said extension having at least two lateral openings constituting outlets which connect said portion of said passage with the surrounding atmosphere.

2. The structure of claim 1, wherein said extension tapers upwardly.

3. The structure of claim 1, wherein the width of said extension is less than the distance between said sidewalls.

4. The structure of claim 1, wherein said top wall is elongated and said openings are disposed in planes making with the longitudinal direction of said top wall angles of between approximately 80 and 90 degrees.

5. The structure of claim 1, wherein at least one of said openings is inclined to the horizontal.

6. The structure of claim 1, wherein said extension has nozzles having orifices which constitute said openings.

7. The structure of claim 6, wherein said nozzles have smooth surfaces surrounding the respective orifices.

8. The structure of claim 6, wherein said nozzles have surfaces surrounding the respective orifices and being configurated to swirl the air flowing from said portion of said passage into the surrounding atmosphere.

9. The structure of claim 1, wherein said top wall is elongated and the dimensions of said openings transversely of said top wall exceed the dimensions of said openings in the longitudinal direction of said top wall.

10. The structure of claim 1, wherein said top wall has a plurality of extensions.

11. The structure of claim 10, wherein the openings in one of said extensions are offset relative to the openings in another of said extensions.

12. The structure of claim 1, wherein said openings are offset with reference to each other.

13. The structure of claim 1, wherein said extension has two lateral portions and at least two openings in at least one of said lateral portions.

14. The structure of claim 1, wherein said top wall is elongated and has a plurality of extensions which are staggered relative to each other in the longitudinal direction of said top wall.

15. The structure of claim 1, wherein the cross-sectional area of at least one of said openings decreases in a direction from said portion of said passage toward the surrounding atmosphere.

16. The structure of claim 1, further comprising a second grate bar adjacent said first named grate bar and having a second extension with openings which are staggered with reference to the openings of said first named extension.

17. The structure of claim 16, further comprising means for coupling said grate bars to each other.

18. The structure of claim 17, wherein said grate bars have neighboring sidewalls and said coupling means includes means for holding said neighboring sidewalls against movement along each other.

19. The structure of claim 18, wherein one of said neighboring sidewalls has a recess and the other of said neighboring sidewalls has a projection in said recess.

* * * * *